US010386143B2

(12) United States Patent
Jones et al.

(10) Patent No.: US 10,386,143 B2
(45) Date of Patent: Aug. 20, 2019

(54) WEAPON MOTION ALERT SYSTEM

(71) Applicants: Curtis Jones, Raleigh, NC (US); Rosa Jones, Raleigh, NC (US)

(72) Inventors: Curtis Jones, Raleigh, NC (US); Rosa Jones, Raleigh, NC (US)

( * ) Notice: Subject to any disclaimer, the term of this patent is extended or adjusted under 35 U.S.C. 154(b) by 0 days.

(21) Appl. No.: 15/612,189

(22) Filed: Jun. 2, 2017

(65) Prior Publication Data

US 2018/0350210 A1 Dec. 6, 2018

(51) Int. Cl.

| | |
|---|---|
| ***F41A 17/06*** | (2006.01) |
| ***G08B 21/02*** | (2006.01) |
| ***G08B 21/24*** | (2006.01) |
| ***G08B 13/14*** | (2006.01) |

(52) U.S. Cl.

CPC ..... *F41A 17/063* (2013.01); *G08B 13/1436* (2013.01); *G08B 21/0288* (2013.01); *G08B 21/24* (2013.01)

(58) Field of Classification Search

CPC ..... G08B 13/1436; G08B 21/0288; G08B 21/24; F41A 17/063

See application file for complete search history.

(56) References Cited

U.S. PATENT DOCUMENTS

| | | | | |
|---|---|---|---|---|
| 5,525,966 | A * | 6/1996 | Parish | F41C 33/0227 224/243 |
| 5,782,028 | A | 7/1998 | Simon et al. | |
| 6,400,269 | B1 | 6/2002 | Savastano | |
| 6,429,769 | B1 | 8/2002 | Fulgueira | |
| 6,433,683 | B1 * | 8/2002 | Robinson | G08B 13/19647 340/426.16 |
| 6,568,116 | B2 | 5/2003 | Jones | |
| 6,678,984 | B1 | 1/2004 | Rapp et al. | |
| 8,653,974 | B2 | 2/2014 | Crook | |
| 8,726,556 | B1 | 5/2014 | Willingham | |
| 8,947,252 | B2 | 3/2015 | Wilson | |
| 2004/0155777 | A1 * | 8/2004 | Mitchell | G08B 13/1427 340/568.1 |
| 2008/0048875 | A1 * | 2/2008 | Chae | G08B 13/1481 340/635 |
| 2010/0315235 | A1 | 12/2010 | Adegoke et al. | |
| 2011/0138667 | A1 * | 6/2011 | Bolden | F41C 27/00 42/1.01 |
| 2016/0377373 | A1 * | 12/2016 | Feldstein | F41C 33/029 42/1.01 |

FOREIGN PATENT DOCUMENTS

| | | |
|---|---|---|
| WO | WO9514901 | 6/1995 |

* cited by examiner

*Primary Examiner* — Mohamed Barakat

(57) ABSTRACT

A weapon motion alert system includes a weapon that may be manipulated. A base unit is provided and the base unit is removably coupled to the weapon. Additionally, the base unit detects motion. A remote unit is provided and the remote unit is positioned on a support surface. The remote unit is in electrical communication with the base unit. The remote unit generates an alarm sequence when the base unit has been moved. In this way the remote unit alerts a user that the weapon has been tampered with.

1 Claim, 4 Drawing Sheets

WEAPON MOTION ALERT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to motion alert devices and more particularly pertains to a new motion alert device for issuing an alarm when a weapon is tampered with.

BRIEF SUMMARY OF THE INVENTION

An embodiment of the disclosure meets the needs presented above by generally comprising a weapon that may be manipulated. A base unit is provided and the base unit is removably coupled to the weapon. Moreover, the base unit detects motion. A remote unit is provided and the remote unit is positioned on a support surface. The remote unit is in electrical communication with the base unit. The remote unit generates an alarm sequence when the base unit has been moved. In this way the remote unit alerts a user that the weapon has been tampered with.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
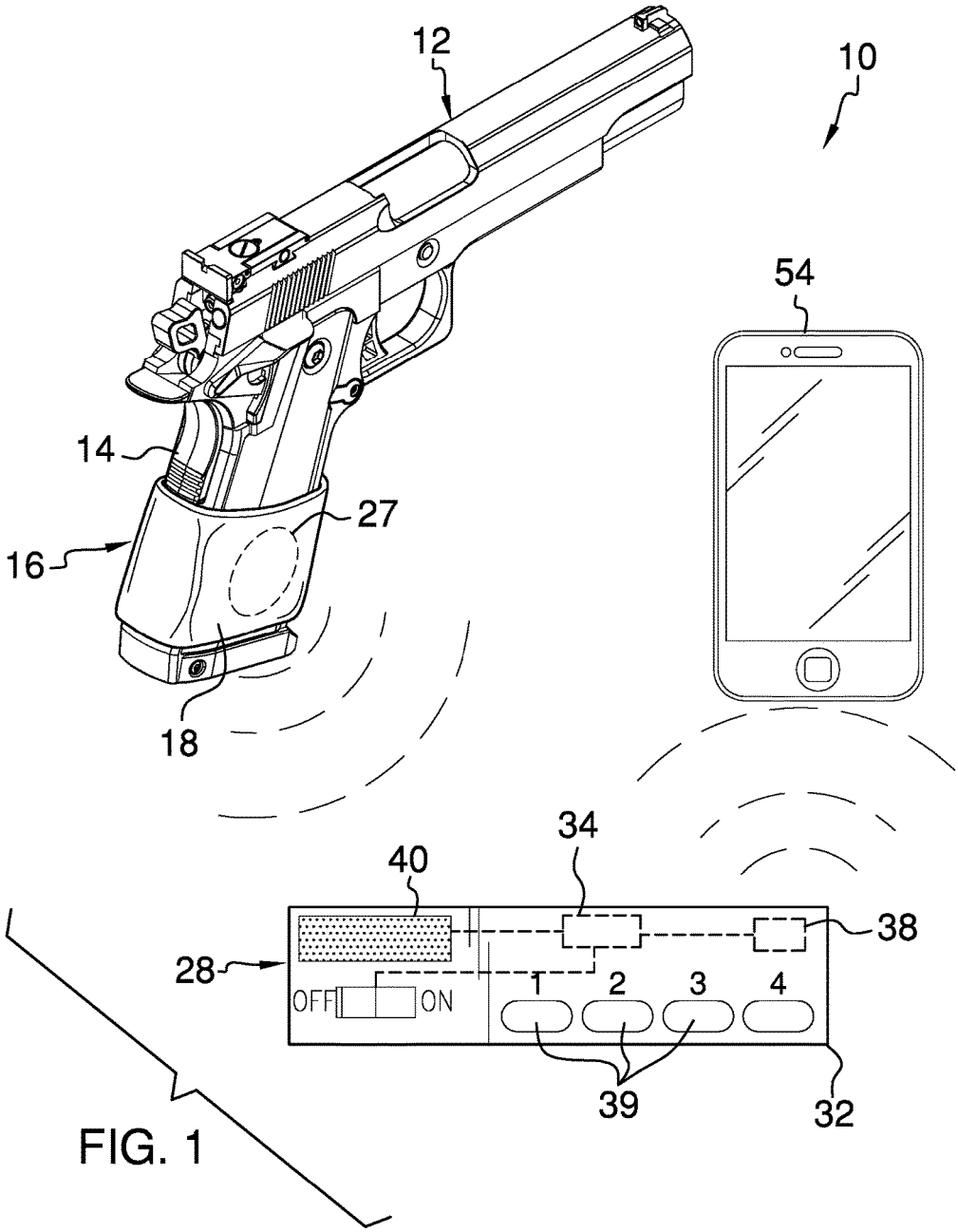
FIG. 1 is a perspective in-use view of a weapon motion alert system according to an embodiment of the disclosure.
Figure 2:
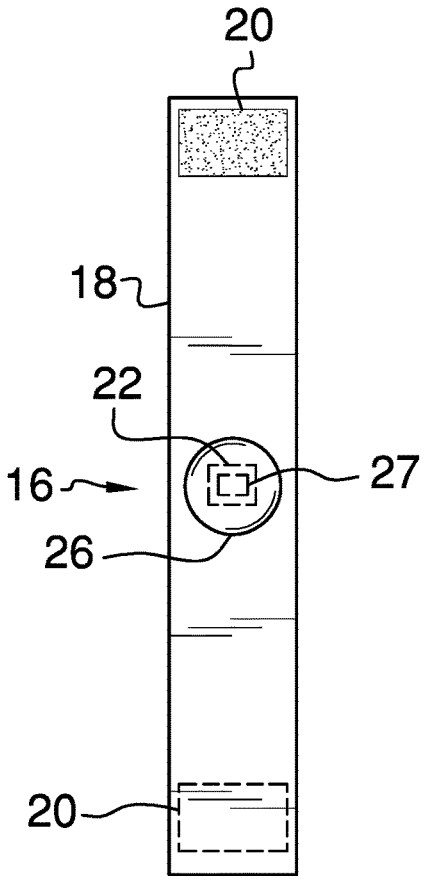
FIG. 2 is a top view of base unit of an embodiment of the disclosure.
Figure 3:
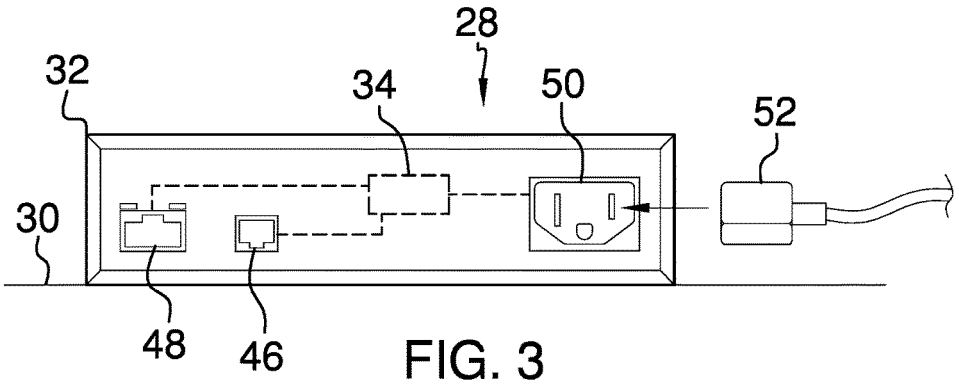
FIG. 3 is a back view of a remote unit of an embodiment of the disclosure.
Figure 4:
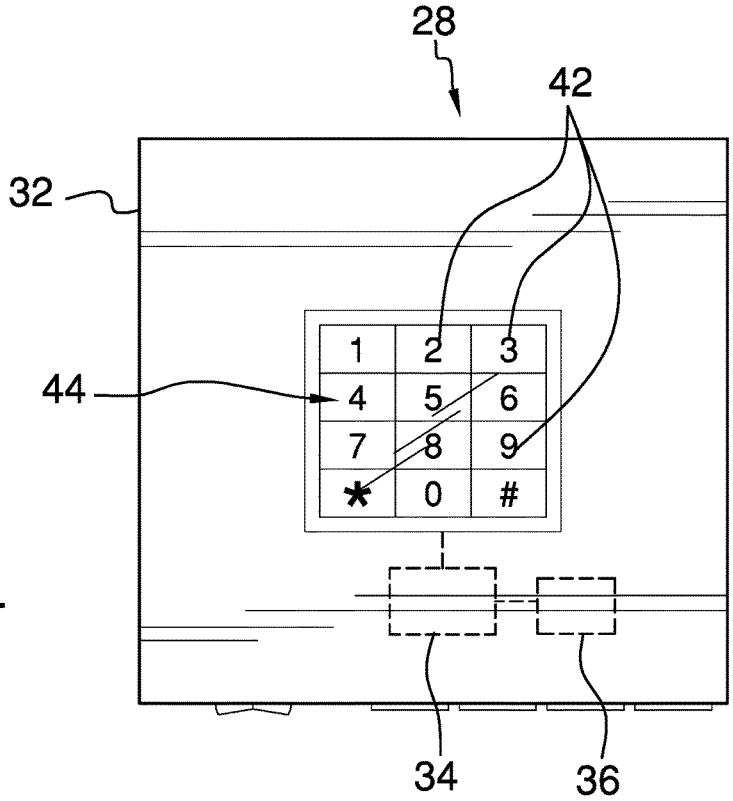
FIG. 4 is a top view of a remote unit of an embodiment of the disclosure.
Figure 5:
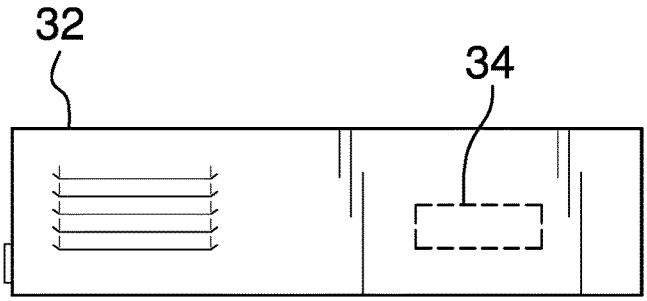
FIG. 5 is a back view of a remote unit of an embodiment of the disclosure.

With reference now to the drawings, and in particular to FIGS. 1 through 5 thereof, a new motion alert device embodying the principles and concepts of an embodiment of the disclosure and generally designated by the reference numeral 10 will be described.

As best illustrated in FIGS. 1 through 5, the weapon motion alert system 10 generally comprises a weapon 12 that may be manipulated. The weapon 12 has a handle 14 and the weapon 12 may be a hand gun, a rifle, a crossbow or any other projectile based weapon 12. A base unit 16 is provided and the base unit 16 is removably coupled to the weapon 12.

The base unit 16 comprises a strap 18 is that is wrapped around the handle 14. A pair of mating members 20 is provided and each of the mating members 20 is coupled to the strap 18. Each of the mating members 20 is positioned at opposite ends of the strap 18 and each of the mating members 20 engages each other. In this way the pair of mating members 20 retains the strap 18 around the handle 14 of the weapon 12. Moreover, each of the mating members 20 may comprise a hook and loop fastener or the like.

A base transceiver 22 is provided and the base transceiver 22 is coupled to the strap 18. The base transceiver 22 may be a radio frequency transceiver or the like that employs a WPAN signal. A base power supply 26 is provided and the base power supply 26 is coupled to the strap 18. The base transceiver 22 is electrically coupled to the base power supply 26 and the base power supply 26 comprises at least one battery.

A motion detector 27 is coupled to the strap 18 and the motion detector 27 is electrically coupled to the base transceiver 22. The motion detector 27 detects when the weapon 12 has been moved. Moreover, the motion detector 27 may be a mechanical motion detector, such as a mercury switch or the like, and the motion detector 27 may be an electronic motion detector. The motion detector 27 is turned on when the motion detector 27 detects that the weapon 12 has moved. Additionally, the base transceiver 22 transmits an alert signal when the motion detector 27 is turned on.

A remote unit 28 is provided and the remote unit 28 may be positioned on a support surface 30. The support surface 30 may be a desk, a table or other object that is placed in proximity to the weapon 12. The remote unit 28 is in electrical communication with the base unit 16 such that the remote unit 28 receives the physical location of the base unit 16. The remote unit 28 generates an alarm sequence when the base unit 16 has been moved. In this way the remote unit 28 alerts a user that the weapon 12 has been tampered with.

The remote unit 28 comprises a housing 32 that is positioned on the support surface 30. A processor 34 is positioned within the housing 32 and the processor 34 selectively generates the alarm sequence. The processor 34 may be an electronic processor 34 or the like. An electronic memory 36 is provided and the electronic memory 36 is positioned within the housing 32. The electronic memory 36 is electrically coupled to the processor 34 and the electronic memory 36 stores a pre-determined alpha numeric code. The electronic memory 36 may be RAM memory or other means of electronic data storage.

A remote transceiver 38 is provided and the remote transceiver 38 is positioned within the housing 32. The remote transceiver 38 is electrically coupled to the processor 34 and the remote transceiver 38 is in electrical communication with the base transceiver 22. The processor 34 generates the alarm sequence when the base transceiver 22 transmits the alert sequence. The remote transceiver 38 may be a radio frequency transceiver or the like and the remote transceiver 38 may be a multi-channel transceiver. A plurality of light emitters 39 may be provided and each of the light emitters 39 may be coupled to the housing 32. Moreover, each of the light emitters 39 may be electrically coupled to the remote transceiver 38 to indicate a channel on which the remote transceiver 38 is communicating.

A speaker 40 is coupled to the housing 32 and the speaker 40 selectively emits an audible alarm. The speaker 40 is electrically coupled to the processor 34 and the processor 34 turns the speaker 40 on when the processor 34 generates the alarm sequence. The speaker 40 may be an electronic speaker 40 or the like.

A plurality of buttons 42 is provided and each of the buttons 42 is coupled to the housing 32 such that each of the buttons 42 may be manipulated. Each of the buttons 42 is electrically coupled to the processor 34 and the plurality of buttons 42 stores the pre-determined alpha-numeric code in the electronic memory 36. The processor 34 ceases generating the alarm sequence when the pre-determined alpha-numeric code is entered with the buttons 42. Indicia 44 may be printed on each of the buttons 42 and the indicia 44 may comprise numerals.

A first port 46 is coupled to the housing 32 and the first port 46 may be electrically coupled to a communication network. The first port 46 is electrically coupled to the processor 34 and the first port 46 may be a telephone port or the like. A second port 48 is coupled to the housing 32 and the second port 48 may be electrically coupled to a communication network. The second port 48 is electrically coupled to the processor 34 and the second port 48 may be an Ethernet port or the like.

A power port 50 is coupled to the housing 32 and the power port 50 is electrically coupled to the processor 34. The power port 50 may be electrically coupled to a power source 52. The power source 52 may be a three prong power cord or the like.

An electronic device 54 is provided and the electronic device 54 may be manipulated. The electronic device 54 is in electrical communication with the remote unit 28. The electronic device 54 alerts the user that the remote unit 28 has generated the alarm sequence. The electronic device 54 is in electrical communication with the remote transceiver 38 and the electronic device 54 may be a smart phone or the like. Additionally, the smart phone may control operational parameters of the remote unit 28 with an app or the like.

In use, the pre-determined alpha-numeric code is chosen by the user and entered into the electronic memory 36 with the buttons 42. The motion detector 27 is turned off when the alpha-numeric code is entered with the buttons 42. The processor 34 generates the alarm sequence when the motion detector is turned on 27. Thus, the speaker 40 emits the audible alarm and the electronic device 54 alerts the user. The user may choose to contact local law enforcement in response to the alarm sequence thereby facilitating local law enforcement to respond to a possible weapon 12 theft. In this way public safety is enhanced by reducing the possibility of a stolen weapon 12 being used in the commission of a crime. The alpha numeric sequence is entered either with the buttons 42 or the electronic device 54 to cause the processor 34 to cease generating the alarm sequence and to turn the motion detector 27 off. Moreover, the base transceiver 22 facilitates the weapon 12 to be located when the weapon 12 is stolen by tracking the alert signal.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A weapon motion alert system comprising:

a weapon being configured to be manipulated, said weapon having a handle;

a base unit being removably coupled to said weapon wherein said base unit is configured to detect motion, said base unit comprising:

a strap being wrapped around said handle, a motion detector being coupled to said strap wherein said motion detector is configured to detect when said strap is moved, said motion detector being turned on when said motion detector detects motion, a base transceiver being coupled to said strap, said base transceiver being electrically coupled to said motion detector, said base transceiver transmitting an alert signal when said motion detector is turned on, and a base power supply being coupled to said strap, said base transceiver being electrically coupled to said base power supply;

a remote unit being configured to be positioned on a support surface, said remote unit being in electrical communication with said base unit such that said remote unit receives the physical location of said base unit, said remote unit generating an alarm sequence when said base unit has been moved wherein said remote unit is configured to alert a user that said weapon has been tampered with, said remote unit comprising:

a housing being configured to be positioned on a support surface, a processor being positioned within said housing, said processor selectively generating said alarm sequence, an electronic memory being positioned within said housing, said electronic memory being electrically coupled to said processor, said electronic memory storing a pre-determined alpha numeric code, a remote transceiver being positioned within said housing, said remote transceiver being electrically coupled to said processor, said remote transceiver being in electrical communication with said base transceiver, said processor generating said alarm sequence when said base transceiver transmits said alert signal, a speaker being coupled to said housing wherein said speaker is configured to emit an audible alarm, said speaker being electrically coupled to said processor such that said processor turns said speaker on when said processor generates said alarm sequence, a plurality of buttons, each of said buttons being coupled to said housing wherein each of said buttons is configured to be manipulated, each of said buttons being electrically coupled to said processor such that said plurality of buttons stores said pre-determined alpha-numeric code in said electronic memory, said processor ceasing generating said alarm sequence when said pre-determined alpha-numeric code is entered with said buttons, a first port being coupled to said housing wherein said first port is configured to be electrically coupled to a communication network, said first port being electrically coupled to said processor, a second port being coupled to said housing wherein said second port is configured to be electrically coupled to a communication network, said second port being electrically coupled to said processor, and a power port being coupled to said housing, said power port being electrically coupled to said processor, said power port being configured to be electrically coupled to a power source; and an electronic device being configured to be manipulated, said electronic device being in electrical communication with said remote unit such that said electronic device alerts a user that said remote unit has generated said alarm sequence, said electronic device being in electrical communication with said remote transceiver.

* * * * *